US008308139B2

(12) United States Patent
Leavelle

(10) Patent No.: US 8,308,139 B2
(45) Date of Patent: Nov. 13, 2012

(54) POWER WINCH

(76) Inventor: Thomas Leavelle, Lake City, FL (US)

( * ) Notice: Subject to any disclaimer, the term of this patent is extended or adjusted under 35 U.S.C. 154(b) by 26 days.

(21) Appl. No.: 12/890,859

(22) Filed: Sep. 27, 2010

(65) Prior Publication Data

US 2012/0074365 A1 Mar. 29, 2012

(51) Int. Cl.
*B66D 1/36* (2006.01)

(52) U.S. Cl. ..... 254/338; 254/342; 254/394; 254/397

(58) Field of Classification Search ..... 254/338, 254/342, 394, 395, 397
See application file for complete search history.

(56) References Cited

U.S. PATENT DOCUMENTS 4,491,301 A * 1/1985 Pendola ..... 254/285
5,607,143 A * 3/1997 Regal ..... 254/342
6,105,727 A * 8/2000 Nakao ..... 187/251
6,478,171 B2 * 11/2002 Freeman ..... 212/179
6,631,885 B2 * 10/2003 Halas ..... 254/225
7,007,927 B2 * 3/2006 Halas ..... 254/225
7,264,228 B2 * 9/2007 Kaiser et al. ..... 254/338
7,275,733 B2 * 10/2007 Svitavsky et al. ..... 254/278

* cited by examiner

*Primary Examiner* — Emmanuel M Marcelo
(74) *Attorney, Agent, or Firm* — Jerry D. Haynes; Law Office of Jerry D. Haynes

(57) ABSTRACT

A power winch for retrieving a load using a strap comprising: a motor, where the motor includes a drive shaft, where the drive shaft extends from the motor and a gear coupling at the end of the drive shaft; at least one gear reducer; at least one drive shaft, where said drive shaft engages the at least one gear reducer; a gear extension in each drive shaft; and four rollers that engage the gears of the at least one drive shaft where the rollers are designated as a first top roller, the second top roller, a first bottom roller, and a second bottom roller, where the first top roller and first bottom roller are aligned in a first vertical plane and a second top roller and second bottom roller are aligned in a second vertical plane. The four rollers are positioned at four different respective vertical heights. A strap interweaves through the four rollers that allows for the movement of the strap through the rollers powered by the motor. In one exemplary embodiment, the power winch further includes a winch drum, where the winch drum is used to collect the strap that is interweaved through the four rollers.

6 Claims, 2 Drawing Sheets

POWER WINCH

BACKGROUND OF THE INVENTION

1. Field of Invention

The present invention relates to a unique design of a power winch that enables the movement of heavy loads in an efficient manner.

2. Description of Related Art

A winch is a mechanical device used to wind or unwind cable or wires. The winch is, in its simplest form, a spool with an attached hand crank. Some winches include the uses of motors powered through gear assemblies and may be powered by electric, hydraulics, pneumatics or even internal combustion engines. Many winches include a braking system that enables the winch to secure in a stationary position during either the winding or unwinding process. Winches are used in various industrial applications and also used in towing cars, boats, or other hitched cargo. Many times straps are retrieved or let out through the use of winches when handling a particular load. When strap is retrieved and the drum increases its diameter, the winch loses most of its pulling power. The loss in power is due to the increasing diameter of the drum, as the strap builds up.

It is therefore advisable and advantageous to have a power winch developed that is able to handle a long strap while maintaining constant speed and gear ratio.

SUMMARY OF THE INVENTION

The present invention relates to a power winch for retrieving a load using a strap comprising: a motor, where the motor includes a drive shaft, where the drive shaft extends from the motor and a gear coupling at the end of the drive shaft; at least one gear reducer; at least one drive shaft, where said drive shaft engages the at least one gear reducer; a gear extension in each drive shaft; and four rollers that engage the gears of the at least one drive shaft where the rollers are designated as a first top roller, the second top roller, a first bottom roller, and a second bottom roller, where the first top roller and first bottom roller are aligned in a first vertical plane and a second top roller and second bottom roller are aligned in a second vertical plane. The four rollers are positioned at four different respective vertical heights. A strap interweaves through the four rollers that allows for the movement of the strap through the rollers powered by the motor. In one exemplary embodiment, the power winch further includes a winch drum, where the winch drum is used to collect the strap that is interweaved through the four rollers.

DETAILED DESCRIPTION

The present invention relates to a power winch assembly that includes a plurality of gears configured in a manner to increase the pulling power of the power winch. The power winch, according to present invention maximizes drive and strap pull by more than 95%.

Figure 1A:
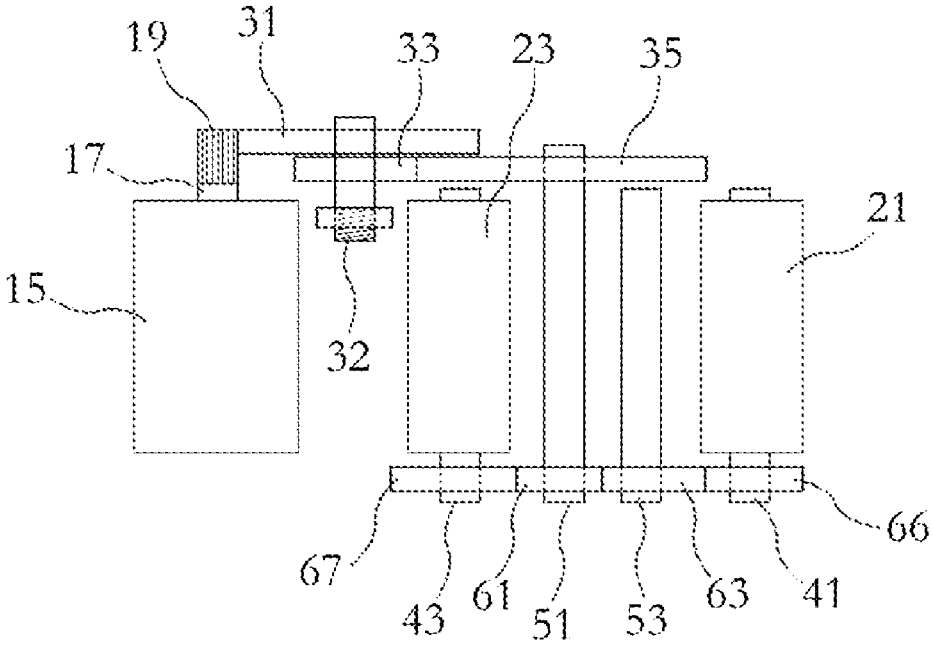
FIG. 1A depicts a top view of a power winch according to the present invention.

In reference to FIG. 1A, a top view of the power winch according to present invention is depicted. The power winch includes a Motor 15 where a Drive Shaft 17 extends from the Motor 15 with a Gearing Coupling 19 at the end of the Shaft 17. The Gearing Coupling 19 of the Motor 15 engages a first gear reducer 31 which in turn rotates a second gear reducer 33 and a third gear reducer 35. The movements of the gears allow for the movement of the Rollers 21 through 24. Top Rollers 21, 23 are depicted in FIG. 1A. The movement of these rollers is determined through the use of Drive Shafts 51, 53. The Drive Shaft 51 extends from the third gear reducer 35 and includes Drive Gear 61. Drive Gear 61 turns the Drive Gear 63 of the Drive Shaft 53 and in turn rotates the Rollers 21, 23. Each roller further includes Roller Shafts 41, 43 and gears 66, 67.

Figure 1B:
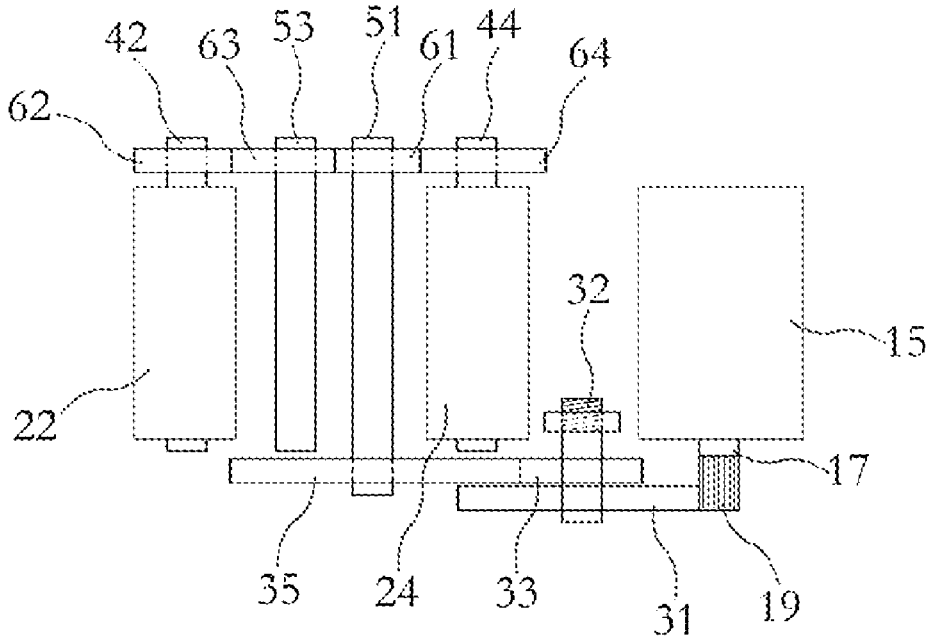
FIG. 1B depicts a bottom view of a power winch according to the present invention.

An opposing bottom view of the power winch according to the present invention is depicted in FIG. 1B. FIG. 1B depicts Bottom Rollers 22, 24. The Bottom Rollers 22, 24 that include Shafts 42, 44 and Gears 62, 64 respectively. Again, the movement of the Drive Shaft 51, 53 enables the movement of the Bottom Rollers 22, 24.

Figure 2:
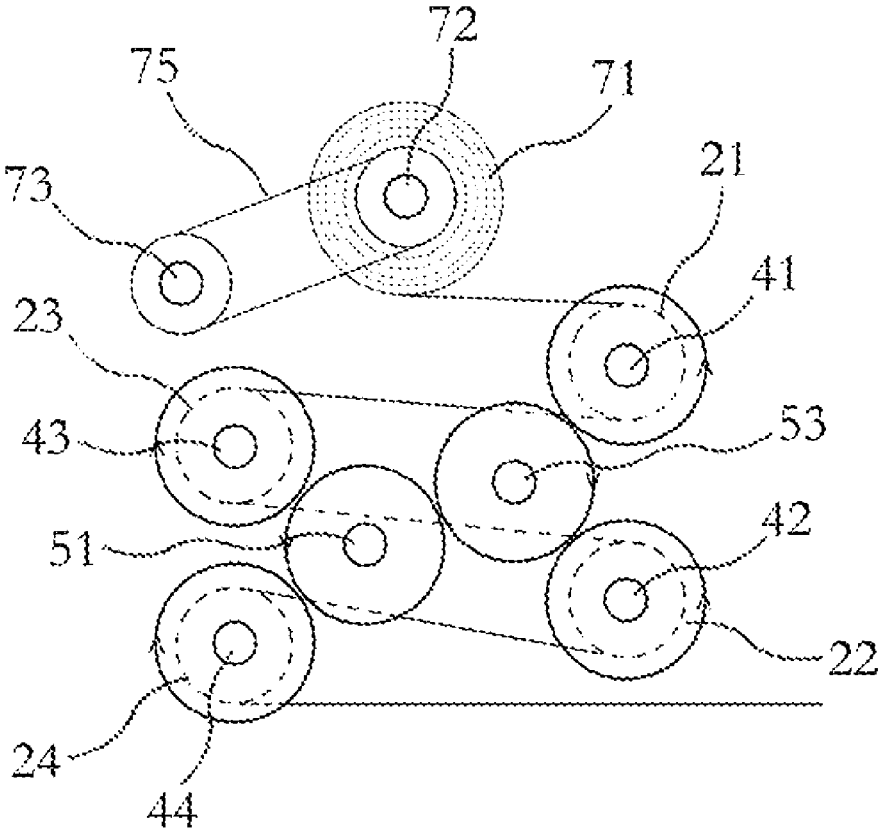
FIG. 2 depicts a side view of the power winch assembly according to the present invention.

The power winch is configured so that the strap interweaves through the Rollers 21 through 24. An exemplary arrangement of the strap through the rollers is depicted in FIG. 2. As shown Strap 71 interweaves through the Rollers 21 through 24 and is collected on a Winch Drum 72. The Strap 71 interweaves through Rollers 21 to 23, back through 22 and around Roller 24. This configuration of movement of the straps helps to reduce tension of the Winch Drum 72. The Winch Drum 72 includes a Winch Handle 73 and a Arm 75 that connects a Handle 73 to the Winch Drum 72. The movement of Rollers 21 through 24 is controlled through the use of the Motor 15 and the Winch Drum 72 provides a means to collect the strap as it moves through the plurality of rollers.

Use of the power winch provides a consistent use of winch power as the strap is collected on the winch drum. The rollers are figured in a manner where Top Roller 21 is above Bottom Roller 22; and Top Roller 23 is above Bottom Roller 24. Between the rollers are positioned Drive Shafts 51, 53. Also it is noted that the rollers are set vertically at different heights where the Bottom Roller 24 is at a vertical height at the lowest point and the Top Roller 21 is at a vertical height at the highest point. The rollers are paired in matching vertical planes where Top Roller 21 and Bottom Roller 22 correspond to one vertical plane and Top Roller 23 and Bottom Roller 24 correspond to a second vertical plane.

The power winch according to the present invention is an extremely effective power winch capable of moving up to a 1,000 load at one end of the strap that enables the use of less than 2 pounds at the winch end to hold or move the attached load while maintaining a constant speed and load capability regardless of length of load bearing strap. This is a superior and effective means of using a winch and is far superior than the winches of the prior art. The instant invention has been shown and described in what it considers to be the most practical and preferred embodiments. It is recognized, however, that departures may be made there from within the scope of the invention and that obvious modifications will occur to a person skilled in the art.

What is claimed is:

1. A power winch for retrieving a load using a strap comprising:

a. a motor, where the motor includes a drive shaft, where the drive shaft extends from the motor and a gear coupling at the end of the drive shaft;

b. at least one gear reducer;

c. at least one drive shaft, where said at least one drive shaft engages the at least one gear reducer;

d. a gear extension in each said at least one drive shaft; and e. four rollers that engage the gears extension of the at least one drive shaft where the rollers are designated as a first top roller, a second top roller, a first bottom roller, and a second bottom roller, where the first top roller and first bottom roller are aligned in a first vertical plane and the second top roller and the second bottom roller are aligned in a second vertical plane.

2. The power winch according to claim 1, where the four rollers are positioned at four different respective vertical heights.

3. The power winch according to claim 1, where the strap interweaves through the four rollers that allows for the movement of the strap through the rollers powered by the motor.

4. The power winch according to claim 1, further including a winch drum, where the winch drum is used to collect the strap that is interweaved through the four rollers.

5. The power winch according to claim 4, where the winch drum includes a winch handle and arm, where the handle and arm are used to collect the strap wound on the winch drum.

6. The power winch according to claim 1, where the at least one gear reducer includes a first gear reducer, where the first gear reducer engages a second gear reducer, and the second gear reducer engages a third gear reducer, where gear reducers engage the at least one drive shaft and provide a means to rotate the at least one drive shaft.

* * * * *